US006189522B1

(12) United States Patent
Moriya

(10) Patent No.: US 6,189,522 B1
(45) Date of Patent: Feb. 20, 2001

(54) WASTE-SPARK ENGINE IGNITION

(75) Inventor: Toru Moriya, Aichi (JP)

(73) Assignee: NGK Spark Plug Co., Ltd., Nagoya (JP)

( * ) Notice: Under 35 U.S.C. 154(b), the term of this patent shall be extended for 0 days.

(21) Appl. No.: 09/247,563

(22) Filed: Feb. 10, 1999

(30) Foreign Application Priority Data

Feb. 12, 1998 (JP) ..... 10-029606

(51) Int. Cl.[7] ..... F02P 15/00

(52) U.S. Cl. ..... 123/643; 123/651; 310/70 A; 310/70 R

(58) Field of Search ..... 123/643, 630, 123/655, 634, 647, 651; 324/393, 399, 388; 313/141, 142; 310/70 A, 70 R, 153

(56) References Cited

U.S. PATENT DOCUMENTS 3,673,452 * 6/1972 Brennen ..... 313/141
3,910,247 * 10/1975 Hartig ..... 123/634
4,463,744 * 8/1984 Tanaka et al. ..... 123/643
4,670,684 * 6/1987 Kagawa et al. ..... 313/141

FOREIGN PATENT DOCUMENTS 63-143387 6/1988 (JP) .
3-206355 9/1991 (JP) .
8-277774 10/1996 (JP) .

* cited by examiner

*Primary Examiner*—Henry C. Yuen
*Assistant Examiner*—Hieu T. Vo
(74) *Attorney, Agent, or Firm*—Foley & Lardner

(57) ABSTRACT

A distributorless ignition system is provided which includes an ignition coil for firing a pair of first and second spark plugs at the same time. The ignition system includes a changeover switch which, when assuming one operating position, causes the first spark plug to produce negative polarity spark and the second spark plug to produce positive polarity spark and, when assuming another operating position, causes the first spark plug to produce positive polarity spark and the second spark plug to produce negative polarity spark. The operating position of changeover switch is changed every time the number of sparks produced by each of the first and second spark plugs becomes two. By this, the number of negative polarity sparks and the number of positive polarity sparks produced by each of the first and second spark plugs on compression stroke at its corresponding cylinder over a long period of time are the same. This enables the center electrode and ground electrode of each of the first and second spark plugs to wear away equally. An ignition method is also provided.

4 Claims, 6 Drawing Sheets

WASTE-SPARK ENGINE IGNITION

BACKGROUND OF THE INVENTION

1. Field of the Invention

The present invention relates to waste-spark ignition of an internal combustion engine (the term "waste-spark" is herein used to indicate a technique of firing two spark plugs at the same time by means of one ignition coil). More particularly, the present invention relates to a method of and apparatus for producing spark for such waste-spark ignition, which is capable of preventing or suppressing occurrence of a difference in the spark plug discharge characteristic between the cylinders due to wear of the electrodes of the spark plugs.

2. Description of the Related Art

In recent multi-cylinder engines is used an electronic ignition system which provides sparks to cylinders without use of a distributor. Enumerated as such an electronic ignition system are (1) first one wherein cylinders which differ in operating cycle phase by 360 degrees are and when one of the paired cylinders is on compression stroke (thus, the other cylinder is on exhaust stroke) two spark plug provided to the respective cylinders are fired at the same time, i.e., a so-called simultaneous ignition or waste-spark type, and (2) another one wherein the spark plugs are fired independently when the respective cylinders are on compression stroke. The first mentioned, waste-spark type of the above mentioned two ignition systems can provide sparks to two cylinders by means of one ignition transformer or coil and therefore superior in cost to the second mentioned type.

FIG. 6 shows a prior art waste-spark or double ended distributorless ignition system 100 wherein a primary winding 2 of an ignition coil or transformer 1 is connected at an end thereof to a direct current source E by way of a key switch or ignition switch K and at another end thereof to a collector of a transistor 4. A secondary winding 3 is connected at opposite ends thereof to spark plugs P1 and P2 provided to rective cylinders N1 and N2 of an engine N, which differ in operating cycle phase by 360 degrees.

Although the actual number of cylinders of the engine N is not always two but six for instance, explanation for other cylinders is omitted for brevity.

With this circuit, an ignition operation is carried out at a predetermined ignition angle in response to the output of a crank angle sensor or the like. Specifically, when the ignition switch K is turned on to connect the direct current source E to the primary winding 2, the voltage at the ignition signal line Sig of the ECU (engine control unit) 5 rises up to turn on the transistor 4, thus allowing current to flow from the direct current source E to the primary winding 2. Thereafter, the voltage at the ignition signal line Sig is lowered at a predetermined ignition timing (e.g., on compression stroke of the cylinder N1) by means of the ECU 5, a high voltage is induced in the secondary winding 3 to cause the first and second spark plugs P1 and P2 to produce sparks, thus igniting the air-fuel mixture in one of the cylinders (e.g., cylinder N1) on compression stroke while producing waste-spark in the other cylinder (e.g., cylinder N2) on exhaust stroke.

However, in case the circuit shown in FIG. 6 is used, the polarity of the high voltage induced in the secondary winding 3 is constant. Thus, negative polarity spark is always produced by the first spark plug P1 in which the more negative potential is caused in the center electrode P1*i* than in the ground electrode P1*o* which is grounded, whereas positive polarity spark is always produced by the second spark plug P2 in which the more positive potential exists in the center electrode P2*i* than in the ground electrode P2*o*.

For this reason, the two spark plugs P1 and P2 differ in the negative potential electrode which is more liable to wear away than the positive potential electrode since it is impacted by positive ions caused by the sparks. Thus, wear of the center electrode P1*i* is mainly caused in the first spark plug P1, whereas wear of the ground electrode P2*o* is mainly caused in the second spark plug P2.

In the meantime, in case ignition is carried out with the above described waste-spark method, sparks are provided to both of the cylinders N1 and N2 on both of their compression and exhaust strokes, but most wear of the electrodes is caused by spark on compression stroke. It is assumed that the electrodes are liable to wear away on compression stroke since on compression stroke the electrodes are subjected to a high pressure and exposed to a high temperature by being surrounded by the flames during spark discharge.

Further, more marked wear results in case natural gas or the like fuel that burns at high temperature is used or high voltage is used to produce the spark for lean-burn.

In this instance, increase of the spark gap due to wear of the electrodes is largely influenced by the wear of the center electrode P1*i* which is smaller in volume. In contrast to this, the ground electrode P2*o* is larger in volume so its wear can increase the spark gap at only a small rate. For this reason, more increase of the spark gap is caused in the first spark plug P1 as eared with the second spark plug P2, thus increasing the voltage necessitated for producing the spark.

However, in case the spark plugs are used in an engine of the type in which the ground electrodes are liable to have a high temperature to be oxidized, there may occur such a case in which the wear of the ground electrodes is accelerated by the oxidization. In such a case, increase of the spark gap is largely influenced by the wear of the ground electrodes.

In any event, the difference in the wear of the spark plug electrode occurs between the cylinders to cause a difference in the spark plug discharge characteristic between the cylinders N1 and N2. Further, such difference in wear causes one of the spark plugs to increase in spark gap excessively, thus causing the life of one of the spark plugs to expire faster than the other, e.g., the life of the first spark plug P1 expires faster than the second plug P2.

In this connection, it is considered to use spark plugs of different part number for the spark plugs P1 and P2 to be put to the engine N, i.e., to use a spark plug with a wear-resistant center electrode P1*i* for the first spark plug P1 and a spark plug with a wear-resistant ground electrode P2*o* for the second spark plug P2. However, this is not desirable since this will cause the part numbers of spark plugs to be controlled, to be doubled and furthermore will induce erroneous installation of spark plugs.

Thus, in order to prevent the wear of the electrodes, it has been practiced to use such spark plugs P1 and P2 in which all of the center electrodes P1*i* and P2*i* and the ground electrodes P1*o* and P2*o* have welded thereto wear-resistant electrode chips. However, one of the wear-resistant electrode chips which are made of an expensive metal such as platinum, iridium, rhodium and rhenium, e.g., the wear-resistant electrode chip attached to the ground electrode P1*o* of the spark plug P1 remains unchanged without having almost any wear even when the chip of the center electrode P1*i* has worn away to cause expiration of the life of the spark plug P1, so one of the wear-resistant electrode chips is wasted.

SUMMARY OF THE INVENTION

With the prior art ignition method and ignition system of the kind in which one ignition coil fires two spark plugs at the same time, a difference in wear between the spark plugs is inevitably caused. Such a difference in wear will lead to a difference in the spark plug discharge characteristic between the cylinders. Furthermore, such a difference in wear will shorten the life of the spark plug and waste costly wear-resistant electrode chips in case the spark plug has such chips provided to the electrodes thereof.

It is an object of the present invention to provide an ignition method for an internal combustion engine which can prevent or suppress occurrence of a difference in the discharge characteristic of a spark plug between cylinders.

It is a further object of the present invention to provide an ignition method of the foregoing character which enable a center electrode and a ground electrode of a spark plug to wear away equally and thereby can elongate the life of the spark plug.

It is a still further object of the present invention to provide an ignition method of the foregoing character which can prevent waste of wear-resistant electrode chips provided to the center electrode and ground electrode of the spark plug.

It is a yet further object of the present invention to provide an ignition system for an internal combustion engine for carrying out the ignition method of the foregoing characters.

In accordance with the present invention, there is provided an ignition method for an internal combustion engine, in which on ignition coil fires a pair of spark plugs at the same time. The method comprises applying high voltage to the spark plugs in such a manner that the number of negative polarity sparks and the number of positive polarity sparks which are produced by each spark plug on compression strokes at its associated cylinder are nearly the same.

In accordance with the present invention, there is also provided an ignition system for an internal combustion engine, in which one ignition coil fires a pair of spark plugs at the same time. The ignition system comprises means for applying high voltage to the spark plugs in such a manner that the number of negative polarity sparks and the number of positive polarity sparks which are produced by each spark plug on compression strokes at its associated cylinder are nearly the same.

DETAILED DESCRIPTION OF THE PREFERRED EMBODIMENTS

The present invention will now be described by way of the following preferred embodiments with reference to the accompanying drawings.

First Embodiment

Figure 1:
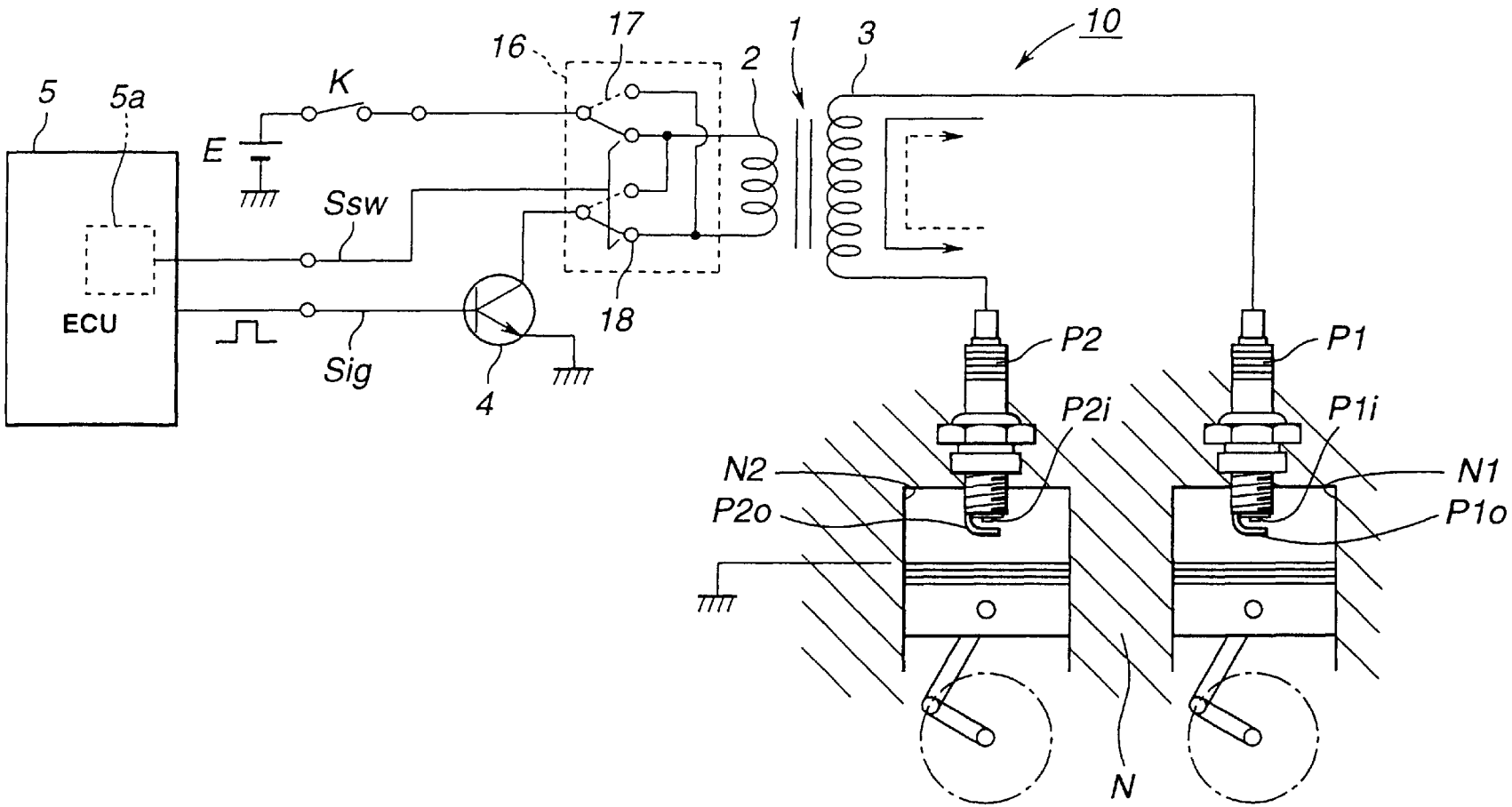
FIG. 1 is a schematic drawing of an ignition system according to the first embodiment of the present invention.

Referring now to FIG. 1, an ignition system according to the first embodiment of the present invention is generally indicated by 10. The ignition system 10 includes, in addition to the above described ignition system 100 (refer to FIG. 6), a switch 16 consisting of a first switch section 17 and a second switch section 18 which are operated in relation to each other, and a switch signal wire Ssw for transmitting a switch signal from the ECU 5 for driving the switch 16. In this connection, the switch 16 is constructed so that the connection of the opposite ends of the primary winding 2 with respect to the direct current source E and the collector of the transistor 4 can be reversed by the operation of the switch 16. Specifically, the switch 16 made up of the first and second switch sections 17 and 18 consists of a relay and is operated by the ECU 5 by way of the switch signal wire Ssw. In the meantime, within the ECU 5 is formed a changeover indicating means 5*a* for generating a signal for reversing (i.e., changing) the operating condition of the switch 16 by way of the switch signal wire Ssw though its detail is not shown.

Figure 6:
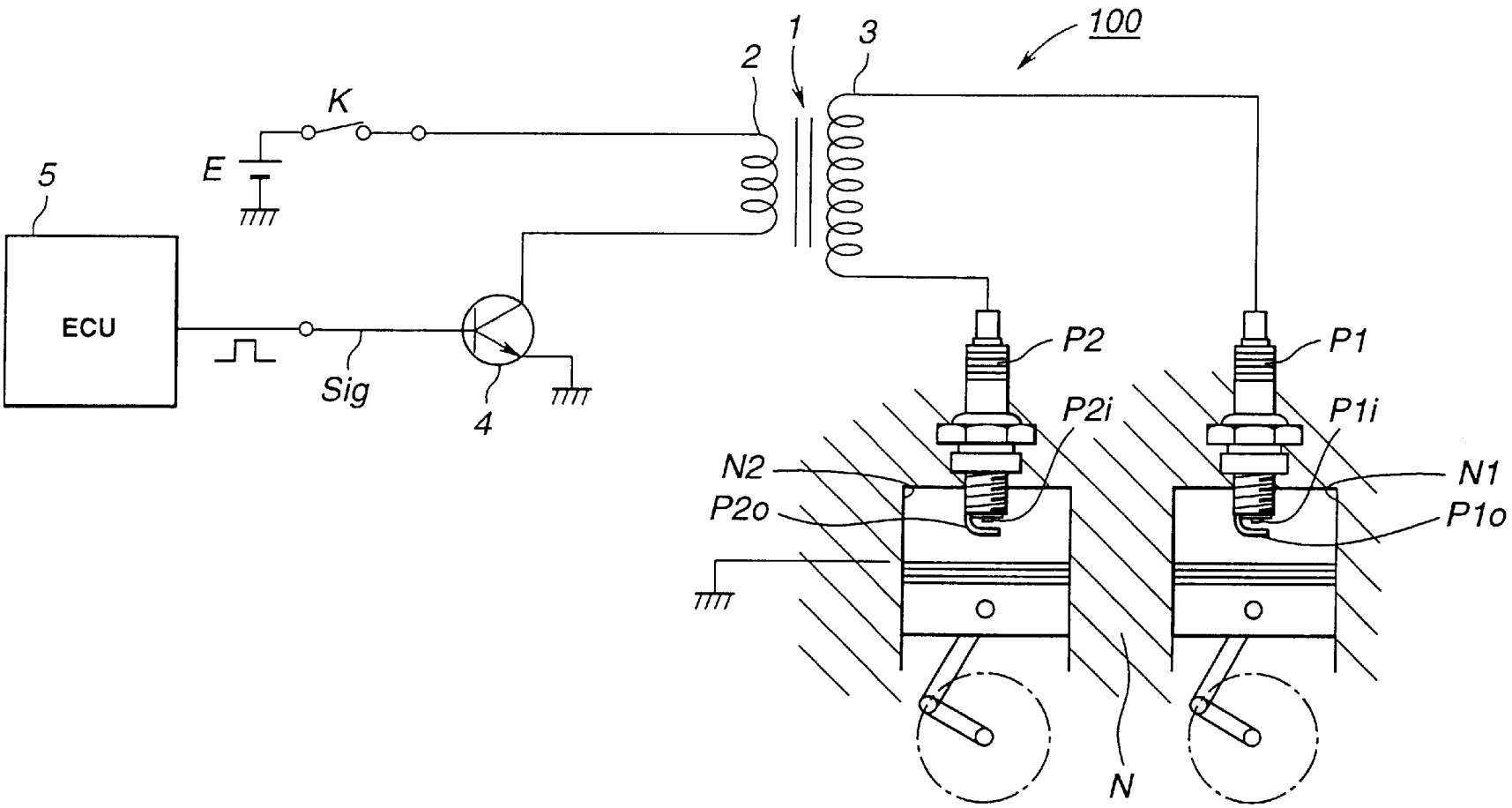
FIG.6 ( PRIOR ART )
FIG. 6 is a prior art ignition system.

Firstly, in case the switch 16 is in an operating condition shown by the solid line in FIG. 1, i.e., the switch sections 17 and 18 are in the condition of being turned down in the drawing, the same circuit as shown in FIG. 6 is constituted so that high voltage current flows through the secondary winding 3 as indicated by the solid line when the voltage at the ignition signal line SIG builds or rises up. Accordingly, with this circuit, negative polarity spark is produced by the first spark plug P1, and positive polarity spark is produced by the second spark plug P2.

On the contrary, in case the switch 16 is in an operating condition indicated by the dotted line, i.e., the switch sections 17 and 18 are in the condition of being turned up in the drawing, the direction of current flow through the primary winding 2 is reversed with respect to that described above, i.e., current flows upward in the drawing, so high voltage current flows through the secondary winding 3 as indicated by the dotted line when the voltage at the ignition signal line Sig is lowered or falls. Accordingly, with this circuit, positive polarity spark is produced by the first spark plug P1, and negative polarity spark is produced by the second spark plug P2.

When the ECU 5 changes the operating condition of the switch 16 from the solid line condition to the dotted line condition or vise versa, the polarity of the high voltage induced in the secondary winding 3 is reversed, thus reversing the polarity of spark of each spark plug.

This is tabulated as shown in table 1. In the table, the solid line condition of the switch 16 in FIG. 1 is indicated "A", the dotted line condition of the switch 16 in FIG. 1 is indicated by "B", negative polarity spark of the spark modes is indicated by "−" and positive polarity spark of the spark modes is indicated by "+".

TABLE 1

| Condition of Switch 16 | A | B |
|---|---|---|
| Polarity of Spark of First Spark plug P1 | − | + |
| Polarity of Spark of Second spark plug P2 | + | − |

Hereinlater, description will be made to the ignition method for the engine N by the use of the ignition system 10. Firstly, in case the switch 16 is in the condition A (i.e., in the solid lane condition), an ignition signal from the ECU 5 is transmitted through the ignition signal wire Sig to turn the transistor 4 on and, after a short while, off. In this manner, when the piston in the first cylinder N1 is on compression stroke and the piston in the second cylinder N2 is on exhaust stroke, negative polarity spark is produced by the first spark plug P1 and positive polarity spark is produced by the second spark plug P2.

Further, when the operating cycle phase advances 360 degrees so that the piston in the first cylinder is on exhaust stroke and the piston of the second cylinder N2 is on compression stroke, negative polarity spark and positive polarity spark are similarly produced by the first and second spark plugs P1 and P2, respectively.

Then, when the number of sparks counted becomes two, a signal is transmitted from the ECU 5 by way of the switch signal wire Sig to put the switch 16 into the condition B (i.e., dotted line condition), and after that an ignition signal is transmitted from the ECU 5 by way of the ignition signal wire Sig to turn the transistor 4 on and, after a while, off. In this manner, when the operating cycle phase advances further 360 degrees so that the piston in the first cylinder N1 is on compression stroke and the piston in the second cylinder N2 is on exhaust stroke, the first spark plug P1 produces positive polarity spark while the second spark plug P2 produces negative polarity spark.

When the operating cycle phase advances further by 360 degrees so that the piston in the first cylinder N1 is on exhaust stroke and the piston in the second cylinder N2 is on compression stroke, the first spark plug P1 produces positive polarity spark while the second spark plug P2 produces negative polarity spark.

Then, a signal is transmitted again from the ECU 5 by way of the switch signal wire Sig to return the switch 16 to the condition A (i.e., solid line condition), so that negative polarity spark is produced by the first spark plug and positive polarity spark is produced by the second spark plug P2 when the piston in the first cylinder N1 is on its compression stroke and the piston in the second cylinder N2 is on its exhaust stroke.

From this time onward, the engine N is driven similarly as above, i.e. , in such a manner that the switch 16 changes its operating condition every time the spark plugs P1 and P2 have sparked twice, respectively.

This is tabulated as shown in table 2. In the meantime, in the table 2, the condition where the piton in the cylinder is on compression stroke is indicated by "CO" and the condition were the piton in the cylinder is on the exhaust stroke is indicated by "EX". Except for the above, the table 2 is substantially similar to table 1.

TABLE 2

| Number of Times of Spark | 1 | 2 | 3 | 4 | 5 | 6 | 7 | 8 | . . . |
|---|---|---|---|---|---|---|---|---|---|
| Condition of Switch 16 | A | A | B | B | A | A | B | B | . . . |
| Piston Stroke at First Cylinder N1 | CO | EX | CO | EX | CO | EX | CO | EX | . . . |
| Polarity of Spark by First Spark Plug P1 | − | − | + | + | − | − | + | + | . . . |
| Piston Stroke at Second Cylinder N2 | EX | CO | EX | CO | EX | CO | EX | CO | . . . |
| Polarity of Spark by Second Spark plug P2 | + | + | − | − | + | + | − | − | . . . |

From this table 2, it is easily understood that in either of the first spark plug P1 and the second spark plug P2 the polarity of spark on compression stroke (surrounded by thick lines) wherein more wear of the electrodes is caused by spark alternates between "−" and "+", i.e., between negative polarity spark and positive polarity spark. That is, it will be seen that by changing the operating condition of the switch 16 (i.e., from A to B or B to A) every time the number of sparks has became two, the polarity of spark on compression stroke is such that the number of negative polarity spark and the number of positive polarity spark produced by either of the two spark plugs P1 and P2 are the same.

Figure 2:
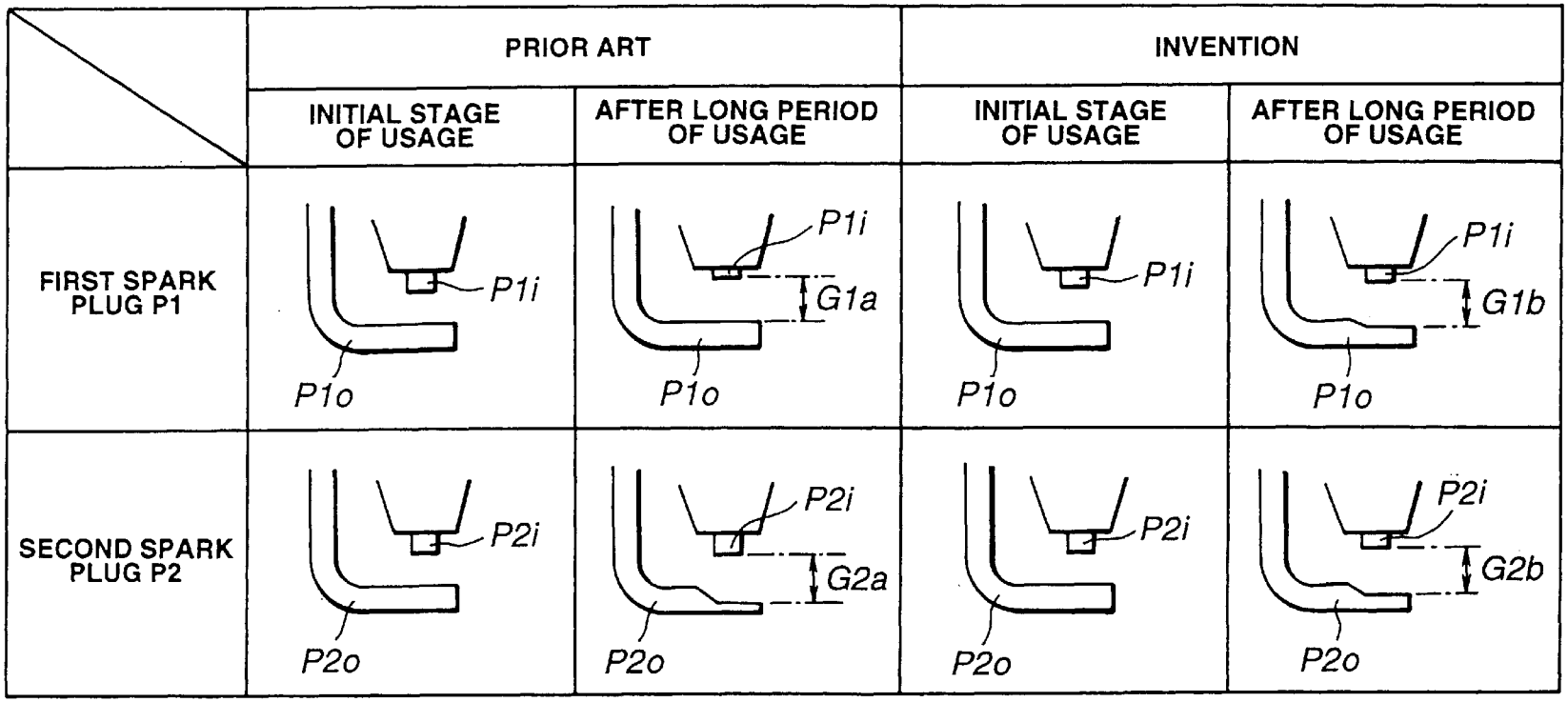
FIG. 2 is an illustration of how a center electrode and a ground electrode of a spark plug changes after a long period of usage, when the spark plug is used in the ignition system of FIG. 1 and a prior art ignition system.

The spark plugs P1 and P2 used in the prior art ignition system 100 shown in FIG. 6 were compared with those used in the ignition system 10 of this invention after a long period of usage and is shown in the left-hand part of FIG. 2. That is, when used in the prior art ignition system 100, the two spark plugs P1 and P2 which was the same in the initial condition worn away after a long period of usage in such a manner that wear of the center electrode P1*i* was mainly caused in the first spark plug P1 and wear of the ground electrode P2*o* was mainly caused in the second spark plug P2. In this instance, wear of the center electrode P1*i* of the first spark plug P1 was so large that the spark gap G1*a* of the first spark plug P1 was lager than the spark gap G2*a* of the second spark plug P2 after a long period of usage, thus causing a difference in the spark discharge characteristic between the spark plugs.

Further, since the spark gap G1*a* has become excessively large, the voltage required for producing spark becomes higher so a defect such as leakage or misfire may be caused, and therefore the replacement of the spark plugs is necessitated, i.e., the life of the spark plugs has expired.

In contrast to this, when the ignition system 10 of this embodiment was used similarly for a long period of time, the result was, as shown in the right-hand part of FIG. 2, such that the center electrode P1*i* and the ground electrode P1*o* worn away equally. This is the same with sect to the spark plug 2. Accordingly, irrespective of the difference in the cylinder N1 or N2, a difference in the spark discharge characteristic between the first and second spark plugs P1 and P2 is scarcely caused even after a long period of usage. Furthermore, the wear of the center electrode P1*i* can be half of the wear of the prior art one, so the spark gaps G1*b* is smaller than G1*a*, That is, the replacement is not yet necessitated, and an elongated life is obtained.

Further, though not shown, in case the ignition system 10 is applied to an engine of the type in which the ground electrode is liable to have a high temperature to be oxidized, wear caused by oxidation is added to wear caused by spark, so particularly the wear of the ground electrode P2*o* of the second spark plug P2 is large. In this instance, contrary to the above described case, the spark gap G2*a* becomes larger than G1*a* after a long period of usage. However, there is eventually no change in that the spark gaps differ from one to another and the spark plugs differ in the spark discharge characteristic from one to another, so also in this case the life of the spark plug expires since the spark gap G2*a* has become too large.

In case the ignition system 10 of this embodiment is applied to such an engine, the center electrodes P1*i* and P2*i* wear away equally with each other, and the ground electrodes P1*o* and P2*o* wear away equally with each other. Accordingly, there is not caused any substantial difference in the spark discharge characteristic between the spark plugs P1 and P2 even after a long period of usage though the spark plugs are provided to the different cylinders N1 and N2, respectively.

Figure 3:
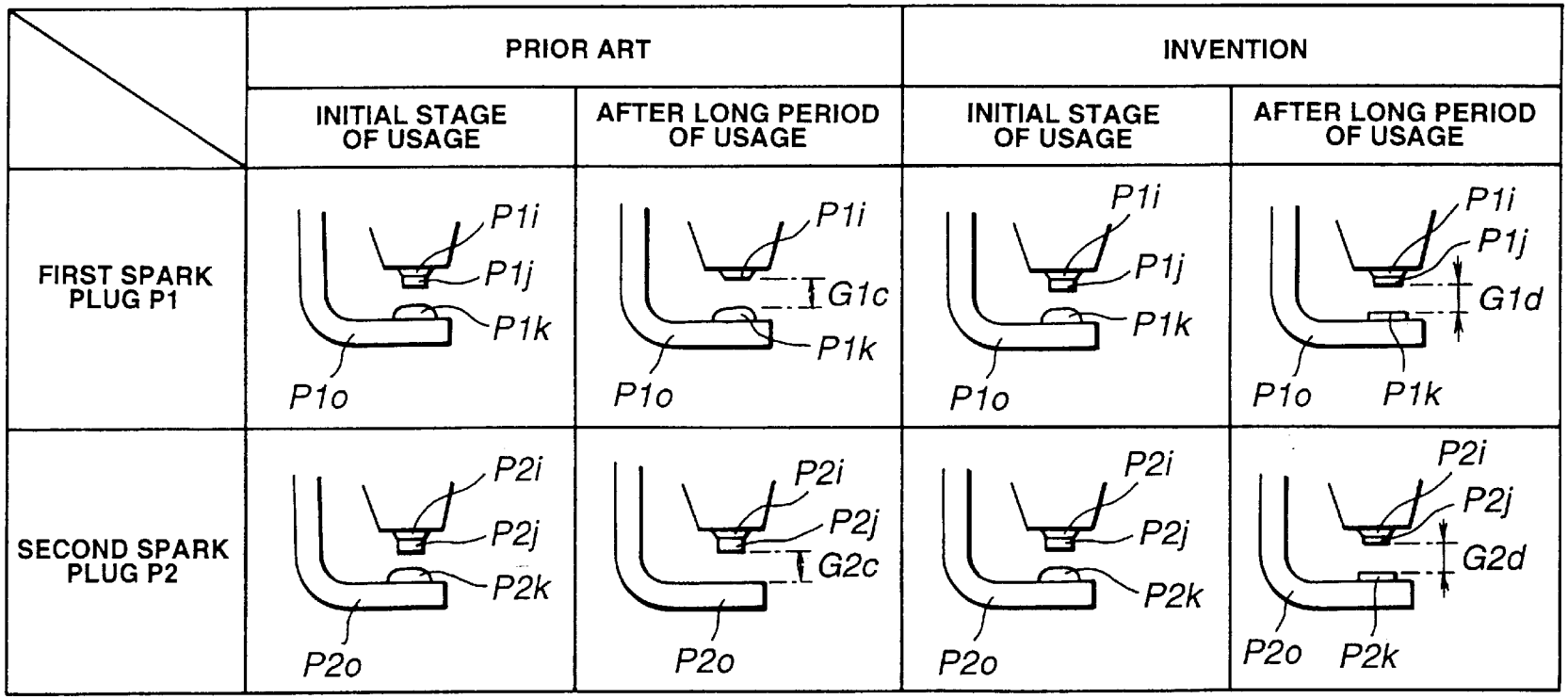
FIG. 3 is an illustration of how a center electrode and a ground electrode of a spark plug which have attached thereto wear-resistant electrode chips, changes after a long period of usage, when the spark plug is used in the ignition system of FIG. 1 and the prior art.

Referring to FIG. 3, it will be described hereinlater such spark plugs P1 and P2 which have platinum chips P1*j*, P2*j* and P1*k*, P2*k* welded to the center electrodes P1*i* and P2*i* and the ground electrodes P1*o* and P2*o*, respectively.

In case such spark plugs P1 and P2 are used in the prior art ignition system 100 (the left-hand side of FIG. 3), wear of the center electrode side chip P1*j* occurs in the first spark plug P1, while wear of the ground electrode side chip P2*k* occurs in the second spark plug P2 after a long period of usage of the spark plugs P1 and P2, though the initial conditions of the spark plugs P1 and P2 are the same. Thereafter, the electrodes whose chips have worn away wear rapidly. That is, in the first spark plug P1, rapid wear of the center electrode P1*i* occurs after the chip P1*j* has worn away. On the other hand, in the second spark plug P2, rapid wear of the ground electrode P2*o* occurs after the chip P2*k* has worn away. Thus, the spark gaps G1*c* and G2*c* become so large that the lives of the spark plugs P1 and P2 expire. However, the costly platinum tips P1*k* and P2*j* still remain in the spark plugs P1 and P2 whose lives have expired and are thus wasted.

In contrast to this, in case the spark plugs P1 and P2 are used in the ignition system 10 for the same long period of time, the center electrode side chip P11 and the ground electrode side chip P1*k* wear away equally as shown in the right-hand side of FIG. 3. The degree of wear of either of the chips is half of that in case of the prior art ignition system. Accordingly, even after a long period of usage, about half of the initial volume of each of the platinum tips P1*j*, P1*k*, P2*j* and P2*k* which are hard to wear away, remains, so the spark gaps G1*d* and G2*d* are hard to became larger. Thus, replacement of the plugs is not yet necessitated, so the lives of the plugs can be elongated considerably (e.g., about 1.5 to two times), thus making it possible to utilize the costly platinum tips P1*j*, P1*k* , P2*j* and P2*k* without vain.

On the contrary, in case an equal life to that of the prior art will suffice for the spark plug, the amount of costly platinum used as the tip can be reduced nearly by half.

While in this embodiment it has been described and shown that the switch 16 is operated to change its operating condition every two times of sparks, any number of times of sparks will do so long as it is equal to two or larger.

Particularly, it is desirable to change the operating condition of the switch 16 every even number of sparks (e.g., every four spark discharges in the table 3). For example, as shown in table 3, if the switchover is performed every even number of times of sparks, the number of times of negative polarity sparks and the number of times of positive polarity sparks on compression stroke in either of the spark plugs P1 and P2 can be the same. For example, from table 3, it will be seen that negative polarity spark and positive polarity spark on compression stroke in either of the spark plugs P1 and P2 occur twice, respectively, during the time up to the eighth spark.

TABLE 3

| Number of times of Spark | 1 | 2 | 3 | 4 | 5 | 6 | 7 | 8 | 9 | ... |
|---|---|---|---|---|---|---|---|---|---|---|
| Condition of Switch 16 | A | A | A | A | B | B | B | B | A | ... |
| Piston Stroke at First Cylinder N1 | CO | EX | CO | EX | CO | EX | CO | EX | CO | ... |
| Polarity of Spark by First Spark Plug P1 | − | − | − | − | + | + | + | + | − | ... |
| Piston Stroke at Second Cylinder N2 | EX | CO | EX | CO | EX | CO | EX | CO | EX | ... |
| Polarity of Spark by Second Spark Plug P2 | + | + | + | + | − | − | − | − | + | ... |

On the other hand, in case the changeover of the switch 16 is carried out every odd number of spark discharge, the number of times of negative polarity spark and the number of times of positive polarity spark are not balanced but differ from each other. However, even in case the changeover is carried out every three times of spark, the ratio of the number of negative polarity spark to the number of positive polarity spark is 2:1 or 1:2, so a difference in the spark discharge characteristic between the cylinders can be prevented or at least made smaller as cared with the prior art spark method in which only negative polarity spark or positive polarity spark is carried out in one spark plug. More preferably, in case the changeover is to be carried out every odd number of spark discharge, the odd number is set to a large number, e.g., nine or more. If the changeover is carried out every nine times of spark, the ratio of the number of times of negative polarity spark to the number of times of positive polarity spark is 5:4 or 4:5, so the difference in the number of time of spark between the two spark modes can be made smaller.

Further, while in this embodiment it has been described and shown that a changeover of the switch 16 is carried out ever predetermined times of spark, it will suffice that the changeover is carried out every random times of spark so long as the number of times of negative polarity spark and the number of times of positive polarity spark on compression stroke are nearly the same after use of the spark plugs over such a period of time that require considerations on the wear of the electrodes. For example, it will suffice that by monitoring the starting of the engine N by means of the ECU 5, the switch 16 is operated by way of the switch signal wire Ssw so as to be turned over every time of starting of the engine N, so that the engine operating condition is changed from the previous operating condition.

Second Embodiment

Figure 4:
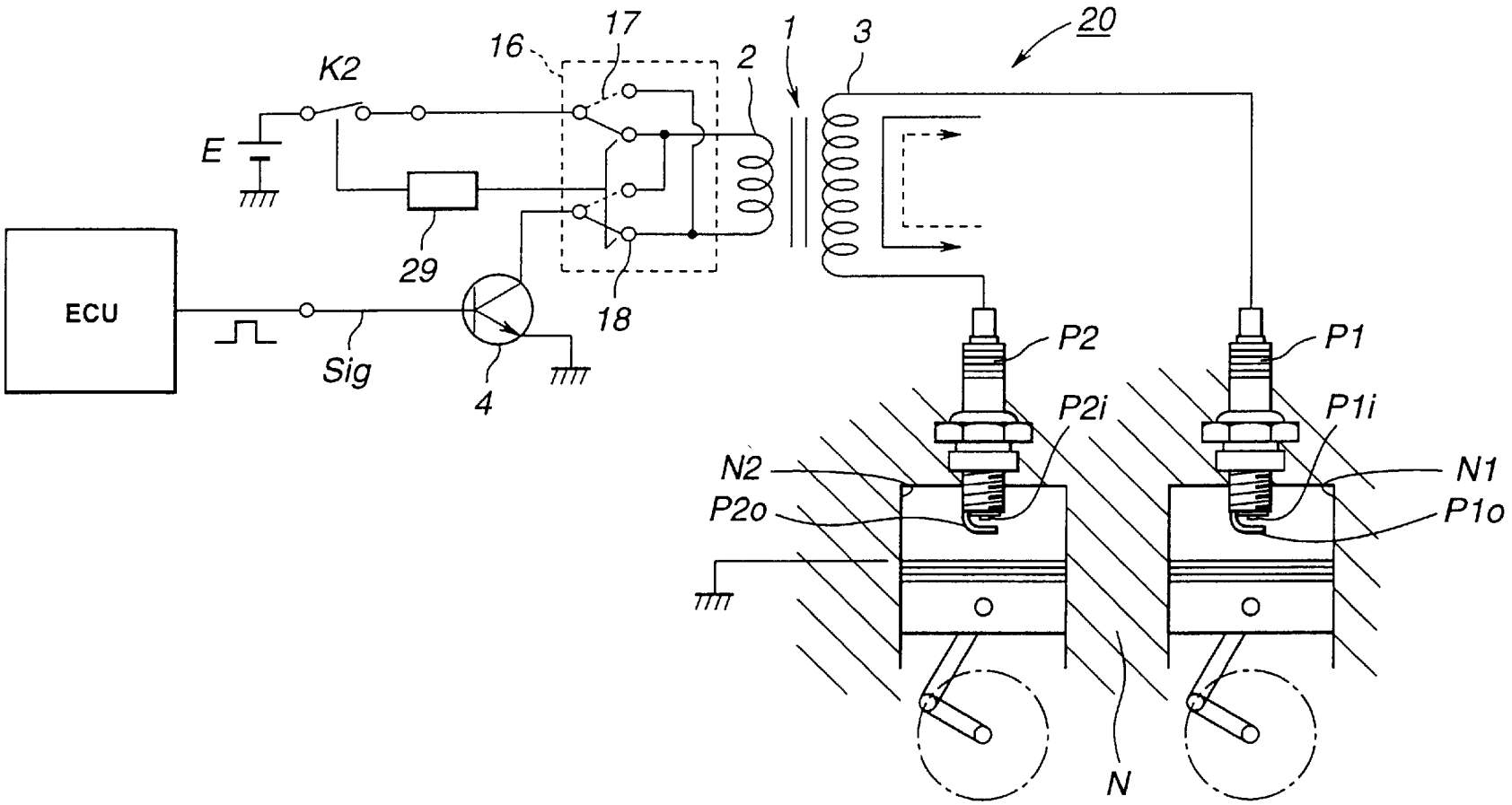
FIG. 4 is a schematic drawing of an ignition system according to another embodiment of the present invention.

Referring to FIG. 4, the second embodiment will be described. The ignition system 20 of this embodiment differs from the first embodiment only in that the changeover of the switch 16 (i.e., switch sections 17 and 18) is not carried out by the ECU 5 by way of the switch signal wire Ssw but carried out by a switch control circuit 29 that monitors the operation of an ignition switch K2, so only the difference will be described and description to the similar parts will be omitted.

The switch control circuit 29 is operated so as to change the operating condition of the switch 16 from one to another every time the ignition switch K2 is turned on, i.e., every time the direct current source E is connected to the primary winding 2. The switch 16 is held at the changed condition even after the operation of the engine N is finished, i.e., the ignition switch K2 is turned off. For this reason, every time the ignition switch K2 is turned on, the switch 16 is changed to a side different from the side at the time of previous starting of the engine N. Such a switch control circuit 29 can be realized by the use of a relay and so on. Further, the switch 16 and the switch control circuit 29 can be put together and structured by the use of relays or the like.

Then, the method of igniting the engine N will be described. In this embodiment, when the ignition switch K2 is operated to connect the direct current source E to the primary winding 2 for starting the engine N and driving the vehicle, the switch control circuit 29 causes the switch 16 to move to one side, e.g., the solid line side in FIG. 4 (i.e., condition A). Thereafter, similarly to the above described first embodiment, the spark plugs P1 and P2 are operated by the signals from the ECU 5 so as to produce sparks. In this connection, since a changeover of the switch 16 is carried out, negative polarity spark is always produced by the spark plug P1 and positive polarity spark is always produced by the spark plug P2.

Thereafter, for the purpose of stopping the car, or the like, the ignition switch K2 is turned off to stop the operation of the engine N. Also in this instance, the switch 16 is maintained at the condition at the time of the operation of the engine N.

When the ignition switch K2 is turned on to start the engine N for the purpose of driving the vehicle, or the like, the switch control circuit 29 changes the operating condition of the switch 16 and causes it to move to the dotted line side or position in FIG. 4 (i.e., condition B). In this instance, reversely to the above, the spark plug P1 always produces positive polarity spark and the spark plug P2 always produces negative polarity spark. From this time onward, stop and start of the internal combustion engine N (vehicle) are repeated in the similar manner as above.

In this manner, every time the engine N starts, the switch 16 is changed to the side different from the side at the previous operation by the switch control circuit 29. In this instance, with respect to only two times of repeated operation of the engine N from start to stop, the number of negative polarity spark and the number of positive polarity spark produced by the spark plugs P1 and P2 on compression stroke of their associated cylinders are not necessarily the same.

However, when the engine N is used for automobiles or the like for instance, it is usually operated so as to repeat start and stop at an interval ranging from several hours to over ten hours at the most. For this reason, during a long period of time which requires considerations on the wear of the electrodes, for example, during a running distance from several thousands to tens of thousands or during a period of time ranging from several months to several years, the period of time during which the switch 16 is in the condition A and the period of time during which the switch 16 is in the condition B are nearly equal to each other, so that the number of times of negative polarity spark and the number of times of positive polarity spark of the spark plugs P1 and P2 on compression stroke of their associated cylinder are nearly equal to each other.

Accordingly, in this embodiment, the center electrodes and the ground electrodes of the spark plugs P1 and P2 wear away equally, thus not causing a difference in the spark characteristic of the spark plug between the cylinders while making it possible to attain an elongated life of the spark plugs.

Third Embodiment

Figure 5:
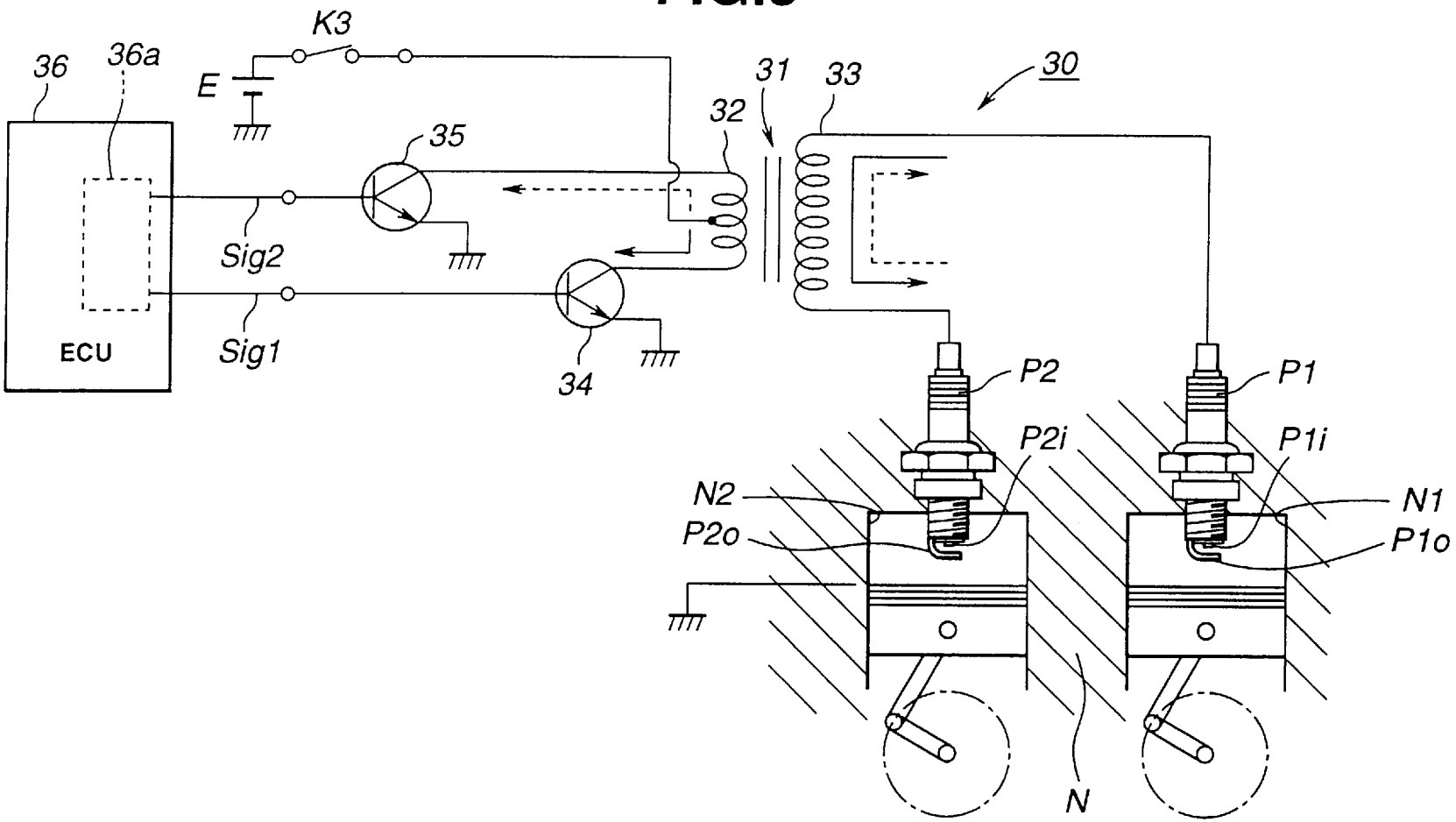
FIG. 5 is a schematic drawing of an ignition system according to a further embodiment of the present invention.

Referring to FIG. 5, the third embodiment will be described.

In the above described first and second embodiments, the direction of current flow through the primary winding 2 is reversed by the switch 16 for thereby reversing the direction of current flow through the secondary winding 3.

However, in the ignition system 30 of this embodiment, a pair of transistors 34 and 35 which are switching elements are used. For this sake, by putting one transistor 34 into operation negative polarity spark is produced by the first spark plug P1 and positive polarity spark is produced by the second spark plug P2. On the contrary, by putting another transistor 35 into operation positive polarity spark is produced by the first spark plug P1 and negative polarity spark is produced by the second spark plug P2.

Specifically, the primary winding 32 of the ignition transformer 31 is connected at the central terminal thereof to the direct current source E by way of the ignition switch K3. On the other hand, the opposite ends of the primary winding 32 are connected to the collectors of the above described transistors 34 and 35. More specifically, the lower end of the primary winding 32, when viewed in the drawing, is connected to the collector of the first transistor 34, whereas the upper end of the primary winding 32 is connected to the collector of the second transistor 35. The first and second transistors 34 and 35 are turned on and off in response to the ignition signal supplied thereto by way of the ignition signal wires Sig1 and Sig2 from the ECU 36. To the opposite ends of the secondary winding 33 are connected, similarly to the first and second embodiments, the first and second spark plugs P1 and P2 which are put to the cylinders N1 and N2 of the engine N, respectively.

By actuating the first transistor 34, i.e., by turning on the transistor 34 for thereby allowing the current to flow in the direction indicated by the solid line and thereafter turning off the transistor 34, high voltage current is caused to flow through the secondary winding 33 in the direction indicated by the solid line, thus causing the first spark plug P1 to produce negative polarity spark and the second spark plug P2 to produce positive polarity spark. On the contrary, by actuating the second transistor 35, i.e., by turning the second transistor 35 on for thereby causing current flow through the primary winding in the direction indicated by the dotted line and thereafter turning the second transistor 35 off, high voltage current is caused to flow through the secondary winding 33 in the direction reversed to the above described direction as indicated by the dotted line, thus causing the first spark plug P1 to produce positive polarity spark and the second spark plug P2 to produce negative polarity spark. Though not shown in detail in the drawing, there is formed within the ECU 36 an ignition signal wire selecting means 36*a* for selecting one of the ignition signal wires Sig1 and Sig2 for transmission of the ignition signal by counting the number of ignition signals produced and reversing selection of the ignition signal wires Sig1 and Sig2 every time the counted number of ignition signals become a predetermined value (two in this Accordingly, by changing the ignition signal wire for thereby changing the transistor to be operated from the first transistor 34 to the second transistor 35, or vise versa, the polarity of the high voltage induced in the secondary winding is reversed, thus reversing the polarities of the sparks produced by the first and second spark plugs P1 and P2, respectively.

This is tabulated as shown in table 4. In the table, ① denotes the case the transistor 34 is operated, i.e., the first transistor 34 is turned on and thereafter off for thereby allowing current to flow in the direction indicated by the solid line, and ② denotes the case the second transistor 35 is operated, i.e., the second transistor 35 is turned on and thereafter off for allowing current to flow in the direction indicated by the dotted line in FIG. 5. Further, similarly to the table 1 of the first embodiment, negative polarity spark of the spark modes is indicated by "−" and positive polarity spark is indicated by "+".

TABLE 4

| Transistor to be operated | ① | ② |
|---|---|---|
| Polarity of spark of First Spark Plug P1 | − | + |
| Polarity of Spark of Second Spark Plug P2 | + | − |

The ignition method for the engine N by using the ignition system 30 will be described hereinlater. Firstly, the ignition switch K3 is turned on to connect the direct current source E to the center terminal of the primary winding 32.

Thereafter, the first transistor 34 is actuated by the ignition signal supplied thereto from the ECU 36 by way of the first ignition signal wire Sig1. That is, the first transistor 34 is turned on and, after a while, off (①). By this, when the piston in the first cylinder N1 is on compression stroke and the piston in the second cylinder N2 is on exhaust stroke, negative polarity spark is produced by the first spark plug P1 and positive polarity spark is produced by the second spark plug P2.

Further, when the operating cycle phase advances 360 degrees so that the piston in the first cylinder N1 is on exhaust stroke and the piston in the second cylinder N2 is on compression stroke, the first transistor 34 is similarly actuated (①), thus causing the first spark plug P1 to produce negative polarity spark and the second spark plug P2 to produce positive polarity spark.

Then, when the second transistor 35 is actuated by supplying thereto the ignition signal from the ECU 36 by way of the second ignition signal wire Sig2 (②) and the operating cycle phase advances 360 degrees further so that the first cylinder N1 is on compression stroke and the second cylinder N2 is on exhaust stroke, positive polarity spark is produced by the first spark plug P1 and negative polarity spark is produced by the second spark plug P2.

When the operating cycle phase advances 360 degrees further so that the piston in the first cylinder N1 is on exhaust stroke and the piston in the second cylinder N2 is on compression stroke, the second transistor 35 is similarly actuated so as to cause the first spark plug P1 to produce positive polarity spark and the second spark plug P2 to produce negative polarity spark.

From this time onward, the internal combustion engine N is driven in such a manner that the transistor to be operated is changed every time the spark plugs P1 and P2 spark twice, respectively.

This is tabulated in table 5. In the table, similarly to the first embodiment, "CO" indicates the condition in which the piston in the cylinder is on compression stroke, and "EX" indicates the condition in which the piston in the cylinder is on exhaust stroke. Others are the same with those of table 4.

TABLE 5

| Number of Times of Spark | 1 | 2 | 3 | 4 | 5 | 6 | 7 | 8 | ... |
|---|---|---|---|---|---|---|---|---|---|
| Transistor to be operated | ① | ① | ② | ② | ① | ① | ② | ② | ... |
| Stroke of First Cylinder N1 | CO | EX | CO | EX | CO | EX | CO | EX | ... |
| Polarity of Spark of First Spark Plug P1 | − | − | + | + | − | − | + | + | ... |
| Stroke of Second Cylinder N2 | EX | CO | EX | CO | EX | CO | EX | CO | ... |
| Polarity of Spark of Second Spark Plug P2 | + | + | − | − | + | + | − | − | ... |

From this table 5, it will be easily understood that in either of the first and second spark plugs P1 and P2 the polarity of spark on compression stroke wherein are wear of the electrodes is caused by the spark (surrounded by the thick lines) alternates between "−" and "+", i.e., between negative and positive. That is, it will be seen that by changing the condition of the switch 16 (i.e., from ① to ② or ② to ①) every time the number of times of spark becomes two, the polarity of spark on compression stroke changes so that the number of times of negative polarity spark and the number of times of positive polarity spark produced by either of the two spark plugs P1 and P2 are the same. This does not change when observation is made over a long period of time.

Accordingly, regarding the spark plugs P1 and P2, the sane as the first embodiment can be said. That is, in case the ignition system 30 of this embodiment is used for a long period of time, the center electrode P1*i* and ground electrode P1*o* wear away equally. This is the same with the spark plug P2. Accordingly, even after a long period of time, a difference in the spark discharge between the spark plugs P1 and P2*i* s scarcely caused even after a long period of usage, though they are installed on the different cylinders N1 and N2. Further, a long life of the spark plugs can be attained.

Further, in case the spark plugs P1 and P2 are of the type having welded to the center electrodes P1*i* and P2*i* and the ground electrodes P1*o* and P2*o* platinum tips which are wear-resistant electrode chips, respectively, it also becomes possible to elongate the life of the spark plug considerably (from about 1.5 to 2 times) similarly to the first element, thus making it possible to utilize the costly platinum tip with efficiency. On the contrary, in case an equal life to that of the prior art will suffice for the spark plug, the amount of platinum tip can be reduced nearly by half, thus making it possible to reduce the amount of costly platinum chip necessitated.

Further, the number of discharge on the basis of which a change of the transistor is made is similar to the changeover of the switch 16 in the first embodiment, so detailed explanation thereto is omitted. That is, so long as the number of times of spark for changing the transistor to be operated is two or more, any number will do. In this connection, it is preferable to change the transistor to be operated every even number of spark. In case the number of times of spark is odd number, the largest possible number, e.g., nine or more is preferable.

Further, the transistor can be changed every random number of times of spark so long as the number of times of negative polarity spark and the number of times of positive polarity spark on compression stroke are nearly the same after such a period of usage that require considerations on the wear of the electrodes. For example, it will suffice that the start of the engine N is monitored by the ECU 36 as to which one the transistors 34 and 35 is to be operated and the transistor to be operated is changed from one which is in operation at the previous engine operation to another.

While the present invention has been described and shown as above with respect to the first to third embodiments, this is not for the purpose of limitation but various variations and modifications thereto can be made without departing from the scope of affixed claims.

For example, while in the first and second embodiments the switch 16 is shown as a relay by way of example, a contactless switch such as a transistor switch can be used in place thereof.

Further, while in the third embodiment a transistor is used as a switch, an electronic device such as MOSET, thyristor GTO can be used in place thereof. Further, various circuit structures can be used to constitute the switching circuit, such as a circuit constituted by using the above described switching device and a circuit in which the above described switching device is combined with a diode, resistor, capacitor, etc. For example, a circuit consisting of two transistors of Darlington connection and a circuit consisting of a switching device and a diode connected to the switching device for protection of reverse voltage can be used for the switching circuit. Further, a differential circuit can be used to constitute a pair of switching circuits.

Further, while in the above described first to third embodiments it is employed such a technique of reversing the direction of primary winding current flow through the primary winding for thereby reversing the polarity of high voltage induced in the secondary winding, it will do to reverse the polarity by reversing the connection of the opposite ends of the secondary winding to the spark plugs P1 and P2 by means of a changeover switch.

What is claimed is:

1. A method for ignition of an internal combustion engine having two spark plugs respectively connected to opposite ends of a secondary winding of an ignition coil, to be fired at the same time, the method comprising:

alternately changing the direction of current flow through a primary winding of the ignition coil for thereby alternately changing the direction of high voltage current flow through the spark plugs, and causing each of said two spark plugs to produce negative polarity spark and positive polarity spark alternately.

2. A method according to claim 1, wherein said step of alternatively changing the direction of current flow is carried out at predetermined intervals so that the number of negative polarity sparks and the number of positive polarity sparks which are produced by each of said two spark plugs on a compression stroke at its associated cylinder after a certain period of operation of the engine are nearly the same.

3. A method according to claim 1, wherein said engine includes a pair of cylinders which differ in operating cycle phase by 360 degrees, and said spark plugs are provided to the respective cylinders for producing sparks at the same time.

4. A method according to claim 1, wherein each of said spark plugs is provided with wear-resistant electrode chips at center electrode and ground electrode, respectively.

* * * * *